United States Patent [19]

Andros

[11] Patent Number: 4,829,690

[45] Date of Patent: May 16, 1989

[54] CREDIT CARD CHAIN HOLDER

[76] Inventor: Theodore A. Andros, 1004 Contorro Ave., Coral Gables, Fla. 33146

[21] Appl. No.: 66,785

[22] Filed: Jun. 26, 1987

[51] Int. Cl.[4] ..... G09F 3/18

[52] U.S. Cl. ..... 40/642; 40/664

[58] Field of Search ..... 40/492, 10 R, 664, 642; 206/37.1, 37.6, 37.7, 37.8, 38.1; 70/456 R, 457; 63/21; 150/147-149

[56] References Cited

U.S. PATENT DOCUMENTS

| | | | |
|---|---|---|---|
| 1,213,903 | 1/1917 | Powell | 24/155 |
| 2,645,833 | 7/1953 | Wistedt | 24/155 |
| 2,985,006 | 5/1961 | DuBois | 206/37.1 |
| 3,242,959 | 3/1966 | Glass | 150/147 |
| 3,357,063 | 12/1967 | Eiben | 24/49 |
| 3,884,059 | 5/1975 | McKee | 40/10 R |
| 4,277,902 | 7/1981 | Miniaci et al. | 40/2 R |

*Primary Examiner*—Robert Peshock
*Assistant Examiner*—Michael Lynch
*Attorney, Agent, or Firm*—John C. Malloy

[57] ABSTRACT

In one embodiment, the card holder includes a U-shaped keeper bar movably attached to one end of a chain. At the other end of the chain is a rectangular, stopper plate. The chain runs through holes in each of the credit cards. The holes are located in like corner regions in each credit card. The cross-sectional area of the chain plus the keeper bar is less than the diameter of the holes.

7 Claims, 1 Drawing Sheet

FIG. 1
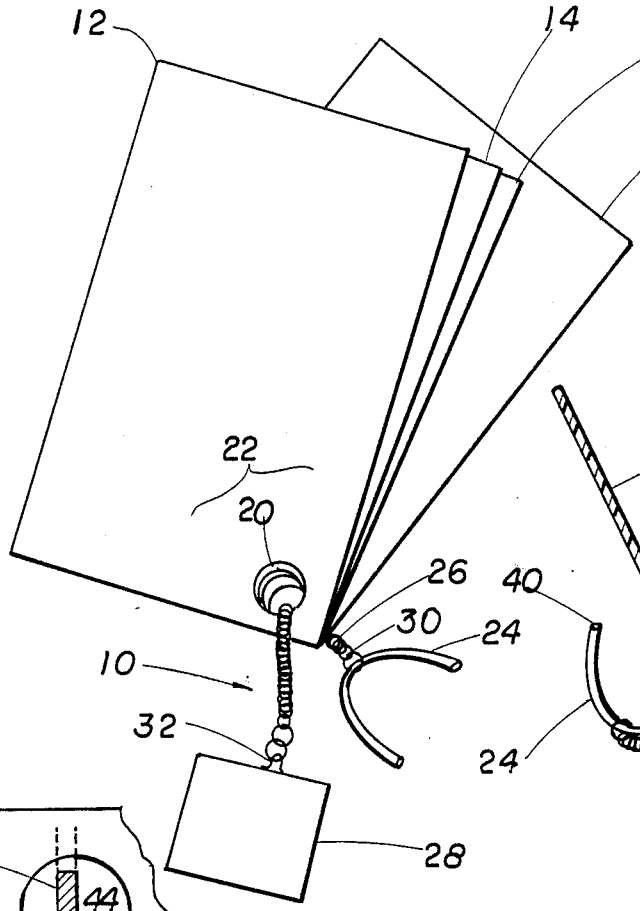
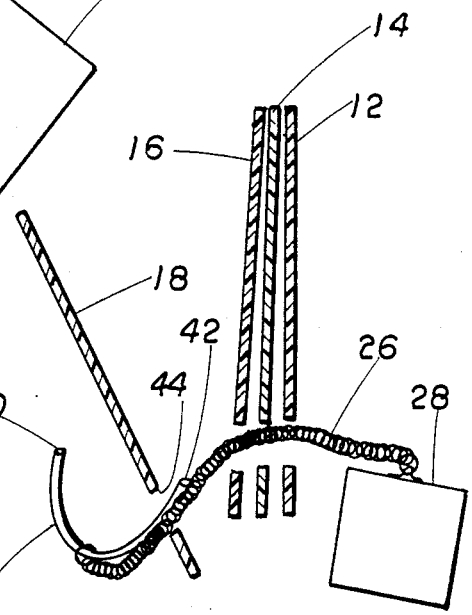
FIG. 2
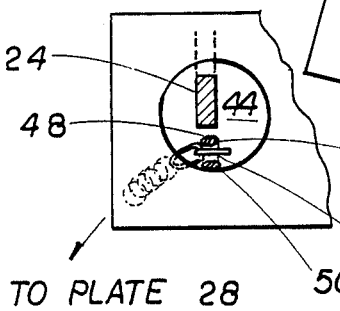
FIG. 3

CREDIT CARD CHAIN HOLDER

BACKGROUND OF THE INVENTION

The present invention relates to a card holder and particularly relates to a credit card holder for retaining a plurality of credit, or other similarly shaped cards, with a flexible chain or linking mechanism.

DESCRIPTION OF THE PRIOR ART

Credit cards and other cards similarly shaped are customarily carried by a great number of people. Many times, each individual will have numerous credit cards. Currently, it seems that there is no mechanism for grouping those credit cards into a single unit other than placing the credit cards into a wallet or wallet-like holder. The present invention provides that individual with a mechanism to retain a great number of credit cards or credit card-like structures in an easily transportable in small key chain-like manner.

U.S. Pat. No. 3,357,063 to Eiben discloses a tie-tac that has a chain attaching a toggle bar to the tie-tac structure that is affixed to the tie. U.S. Pat. No. 4,277,902 to Miniaci, et al., disclose a baggage identification tag with a foldable label having a hole therethrough and a rubberband-like, geometrically closed string running through the hole. U.S. Pat. No. 2,645,833 to Wistedt discloses a pin fastener having a ball at one end of a rod and a spring metal attachment at the other end of the rod. U.S. Pat. No. 1,123,903 to Powell discloses a hat pin wherein a handle is attached at one end of a rod and the rod fits into a sleeve.

OBJECTS OF THE PRESENT INVENTION

It is an object of the present invention to provide a key chain-like structure for retaining a plurality of credit cards or other cards having a similar structure.

It is a further object of the present invention to provide a card holder that is a flexible and compact assembly and yet when the credit cards are retained between a keeper bar and a stopper piece of the holder, the credit cards are securely retained and are not able to be detached or removed from the holder without significant human intervention.

It is another object of the present invention to provide a card holder utilizing a U-shaped keeper bar with a linking means at the base of the U-shaped bar which securely retains the card in a normal operative mode and which promotes detachment of the cards is a dismounting operative mode.

It is an additional object of the present invention to provide a card holder which can retain a large number of credit card-like structures.

SUMMARY OF THE INVENTION

In one embodiment, the card holder includes a U-shaped keeper bar movably attached to one end of a chain. At the other end of the chain is a rectangular, stopper plate. The chain runs through holes in each of the credit cards. The holes are located in like corner regions in each credit card. The cross-sectional area of the chain plus the bar is less than the diameter of the holes in order to facilitate removal of the cards from the holder.

BRIEF DESCRIPTION OF THE DRAWINGS

Further objects and advantages of the present invention can be found in the accompanying description of the preferred embodiments when taken in conjunction with the accompanying drawings in which:

FIG. 1 illustrates a perspective view of the card holder with a plurality of credit card-like structures retained by the holder;

FIG. 2 illustrates a cross-sectional view of the credit card-like structures with one credit card being removed or detached from the card holder; and, FIG. 3 illustrates a broken away, detailed view of the hole through one credit card during the dismounting operative mode and shows the cross-sectional areas of the keeper bar and the linking means.

DETAILED DESCRIPTION OF A PREFERRED EMBODIMENT

The present invention relates to a card holder which retains a plurality of credit card-like structures.

FIG. 1 illustrates a perspective view of card holder 10 retaining card structures 12, 14, 16, and 18. Structures 12, 14, 16, and 18 are a thin, planar, plate structures. These plate structures can be credit cards or similarly shaped, elongated, rigid, thin, and planar cards that generally have similar structural characteristics as compared with commonly available credit cards. As used herein, the term "credit card" is meant to encompass both commonly recognized credit cards and other types of planar plate structures similar to credit cards. Each card 12, 14, 16, and 18 has a hole therethrough. Card 12 has a hole 20 in a corner region 22. In a similar fashion, cards 14, 16 and 18 have holes in a like corner regions similar to corner region 22 of card 12. These holes need not be precisely aligned but when the holes are within the same corner region, the credit cards can be positioned to form a compact, solid rectangular, but freely movable assembly. Therefore, all the cards are easily carried when they are so positioned.

Holder 10 includes a U-shaped keeper bar 24, a linking means 26 and a stopper piece 28. In one embodiment, U-shaped keeper bar 24 and stopper piece 28 are metal. Stopper piece 28 in this embodiment is an identification plate and is a thin, planar, rigid metal sheet that has a size substantially greater than the diameter of the holes through each of the cards. Particularly, stopper piece 28 is much wider than the diameter of hole 20 of card 12. Also in this embodiment, linking means 26 is a linked chain which enables both holder 10 and cards 12, 14, 16, and 18 to be freely moved with respect to each other. This free movement enables the person to confirm the presence of absence of any one credit card without turning numerous pages in a wallet-type credit card holder. End 30 of chain 26 is attached to the bottom of the U-shaped keeper bar 24. This attachment at the bottom or the mid-section region of the U-shaped keeper bar results in securely retaining the plurality of cards since the most adjacent card 18 cannot be detached from the holder without significant human intervention. The other end 32 of chain 26 is movably attached to stopper piece 28. Link chain 26 is movably attached via first and second rotatable couplings to keeper bar 24 and stopper plate 28. This feature facilitates the detachment of one or more cards from the holder.

FIG. 2 illustrates cards 12, 14, 16, and 18 in cross-section and particularly the detachment operation utilized to mount or dismount card 18 on holder 10. Keeper bar 24 has extensive ends 40 and 42. To accomplish such mounting or dismounting, the linking means or chain 26 is disposed in substantially aligned relation to either one of the opposite ends 40 or 42 to concurrently pass through the holes in the credit cards. For example, as shown best in FIG. 2, end 42 is inserted into hole 44 along with the substantially aligned linking chain 26. The balance of keeper bar 24 is then passed through the hole.

As shown in FIG. 3, the cross-sectional area of keeper bar 24 plus the cross-sectional area encompassed by linked chain 26 is less than the diameter of hole 44. As used herein, the "cross-sectional area encompassed" by linked chain 26 is that area described by an imaginary circle concentric with the longitudinal axis of the chain and having portions of the circumference of the circle co-extensive with the greater radial peripheral portions of a respective link. In FIG. 3, link 46 has greater peripheral portions 48 and 50.

Modifications and changes of the present invention are meant to be encompassed by the appended claims. For example, keeper bar 24 does not have to have a rectangular cross-section but can have a circular cross-section. Chain 26 could be a round, flexible, wire, rope or string. Stopper piece 28 may carry indicia that is unique to the owner and holder of cards 12, 14, 16, and 18. For example, stopper plate 28 may carry identification information or a credit card theft warning. Also, stopper piece 28 need not necessarily be a plate but may be any other structure which is larger than the holes through the cards thereby preventing the cards from being detached from holder 10. All the components of holder 10 may be of a non-metallic material. The claims appended hereto are meant to cover these and other changes within the scope and spirit of the present invention.

In a preferred embodiment, the stopper piece 28 may be in the shape of and actually comprise a safety pin with the chain being attached to the hinge end of the safety pin. Using this species, a traveler may pin the safety pin in the pocket of his trousers or in a purse. To use the credit cards, the user merely pulls the cards from the pocket, the chain being long enough for use of the cards; but the cards always remain attached to the clothing of the user, which not only insures against forgetting the cards after use, but also foils pick pockets. Needless to say other types of fastener means, such as a clip, may be used instead of a safety pin. Finally, since credit cards are of similar size as driver's licenses and club membership cards, for example, it is seen that a convenient secure and portable card storage device has been disclosed.

What I claim is:

1. A credit card holder retaining a plurality of cards each having a hole therethrough, said holder comprising:

a. a substantially rigid material keeper bar having an elongated U-shaped base extending continuously between opposite ends of said keeper bar, b. an elongated flexible material linking means mounting said plurality of cards thereon, said linking means having one end attached at a fixed location to said base between said opposite ends of said keeper bar, each of said opposite ends extending in a common direction away from said fixed location so that said opposite ends cannot be aligned simultaneously with said linking means;

c. a stopper piece attached to another end of said linking means and being larger than the holes in the credit cards and thereby being unable to pass therethrough;

d. said linking means having sufficient flexibility to define free movement thereof relative to said keeper bar and positionable in substantially aligned relation with either one of said opposite ends thereof during passage of said keeper bar and the linking means concurrently through the credit card holes during mounting or dismounting of the credit cards on the holder; and e. the cross sectional size of said keeper bar plus the cross sectional area encompassed by said linking means collectively being less than the diameter of said credit card holes.

2. A holder as claimed in claim 1 wherein said cards are thin, planar plate structures and said holes are positioned in like corner regions on each card thereby enabling the formation of a compact, solid rectangular card assembly when said cards are retained by said holder.

3. A holder as claimed in claim 1 wherein said linking means is a linked chain.

4. A holder as claimed in claim 3 wherein said stopper piece is a thin, planar, rigid sheet.

5. A holder as claimed in claim 3 wherein said cross-sectional area encompassed by said chain is an imaginary circle concentric with the longitudinal axis of said chain and defined by the greater radial peripheral portions of respective links in said chain.

6. A holder as claimed in claim 3 wherein said linked chain is movably attached via a first and a second rotatable coupling respectively to the fixed location of said keeper bar and said stopper piece.

7. A holder as in claim 1 wherein the linking means is connected at the fixed location to the base of said keeper bar substantially midway between said opposite ends of said keeper bar.

* * * * *